US010933449B2

(12) United States Patent
Gelber et al.

(10) Patent No.: US 10,933,449 B2
(45) Date of Patent: Mar. 2, 2021

(54) MAGNETICALLY CONTROLLED PARTICLE ABRASION METHOD FOR BIOFOULING REMOVAL

(71) Applicant: Northwestern University, Evanston, IL (US)

(72) Inventors: Alex B. Gelber, Evanston, IL (US); Yuehan Yao, Evanston, IL (US); Morgan L. Petrovich, Evanston, IL (US); George F. Wells, Evanston, IL (US); Kyoo-Chul Park, Evanston, IL (US); Youhua Jiang, Chicago, IL (US)

(73) Assignee: Northwestern University, Evanston, IL (US)

( * ) Notice: Subject to any disclaimer, the term of this patent is extended or adjusted under 35 U.S.C. 154(b) by 0 days.

(21) Appl. No.: 16/193,224

(22) Filed: Nov. 16, 2018

(65) Prior Publication Data

US 2019/0151905 A1 May 23, 2019

Related U.S. Application Data

(60) Provisional application No. 62/587,913, filed on Nov. 17, 2017.

(51) Int. Cl.

| | |
|---|---|
| ***B08B 7/00*** | (2006.01) |
| ***B08B 17/02*** | (2006.01) |
| ***B08B 1/00*** | (2006.01) |
| ***B08B 7/02*** | (2006.01) |
| ***E02B 17/00*** | (2006.01) |
| ***B63B 59/04*** | (2006.01) |

(52) U.S. Cl.

CPC ..... *B08B 7/0014* (2013.01); *B08B 1/00* (2013.01); *B08B 7/02* (2013.01); *B08B 17/02* (2013.01); *B63B 59/04* (2013.01); *E02B 17/0017* (2013.01)

(58) Field of Classification Search

None

See application file for complete search history.

(56) References Cited

U.S. PATENT DOCUMENTS

| | | | |
|---|---|---|---|
| 8,080,285 | B2 | 12/2011 | Beigbeder et al. |
| 2010/0314575 | A1 | 12/2010 | Gao et al. |
| 2016/0074816 | A1 | 3/2016 | Ginic-Markovic et al. |
| 2019/0009190 | A1* | 1/2019 | Greene ..... B01L 3/502707 |

FOREIGN PATENT DOCUMENTS

| | | |
|---|---|---|
| JP | 2007-319735 | * 12/2007 |

OTHER PUBLICATIONS

Machine Translation of JP2007-319735 by Akashi et al., published Dec. 13, 2007.*

* cited by examiner

*Primary Examiner* — Mikhail Kornakov
*Assistant Examiner* — Ryan L. Coleman
(74) *Attorney, Agent, or Firm* — Bell & Manning, LLC

(57) ABSTRACT

Methods of removing a film of a biological material from a surface are provided. In embodiments, such a method comprises applying magnetic particles to a surface contaminated with a film of a biological material; and exposing the magnetic particles to a changing magnetic field to move the magnetic particles relative to the contaminated surface, thereby removing the film from the surface.

6 Claims, 5 Drawing Sheets

MAGNETICALLY CONTROLLED PARTICLE ABRASION METHOD FOR BIOFOULING REMOVAL

CROSS-REFERENCE TO RELATED APPLICATION

The present application claims priority to U.S. provisional patent application No. 62/587,913 that was filed Nov. 17, 2017, the entire contents of which are incorporated herein by reference.

BACKGROUND

Biofouling is the process of growth of unwanted biological materials on a surface. Biofouling poses major operational and economic problems in industries such as shipping, electric power generation, and water treatment. Many of the current technologies (e.g., use of biocides, patterned surfaces, ultrasonic waves, UV radiation, laser removal, surface heating, and physical abrasion or scrubbing) to combat this process are ineffective, inefficient, and environmentally hazardous.

SUMMARY

This disclosure provides a new antibiofouling technology that removes biofouling materials from surfaces. The technology uses a changing magnetic field to drive the motion of magnetic particles which remove the biofouling materials from the target surface.

Methods of removing a film of a biological material from a surface are provided. In embodiments, such a method comprises applying magnetic particles to a surface contaminated with a film of a biological material; and exposing the magnetic particles to a changing magnetic field to move the magnetic particles relative to the contaminated surface, thereby removing the film from the surface.

Other principal features and advantages of the disclosure will become apparent to those skilled in the art upon review of the following drawings, the detailed description, and the appended claims.

BRIEF DESCRIPTION OF THE DRAWINGS

Illustrative embodiments of the disclosure will hereafter be described with reference to the accompanying drawings.

FIG. 2A shows images of a *P. aeruginosa* biofilm after drying for 20 min before being subjected to the present method (left) and after (right).

FIG. 2B shows images of a *P. aeruginosa* biofilm after drying for 60 min before being subjected to the present method (left), after being subjected to 10 minutes of a changing magnetic field (middle) and after being subjected to 15 minutes of a changing magnetic field (right). FIG. 2C plots the removal ratio of the biofilm of FIG. 2B versus the length of exposure to the changing magnetic field.

DETAILED DESCRIPTION

Figure 1:
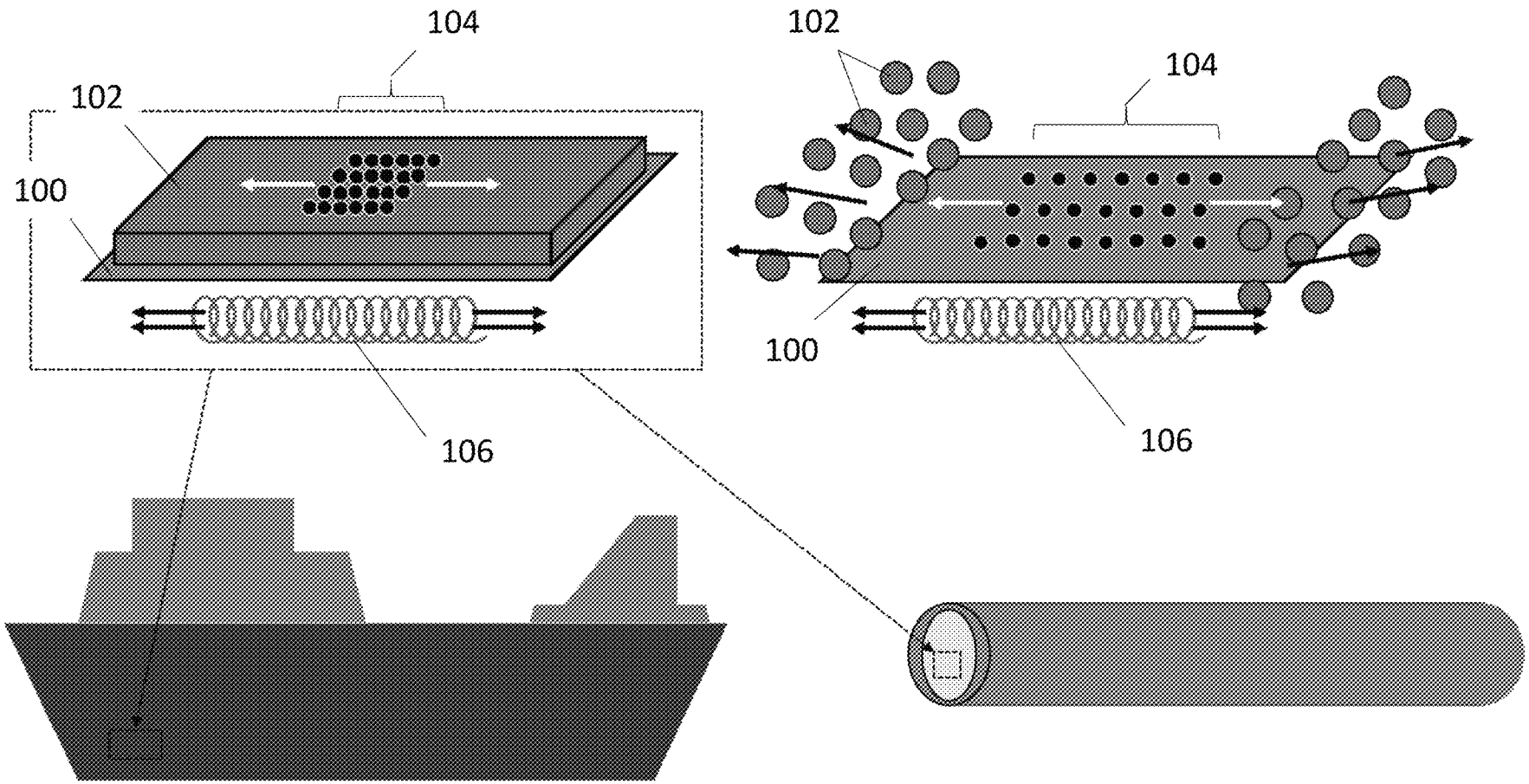
FIG. 1 illustrates a method of removing a film of a biological material according to an illustrative embodiment.

The present disclosure provides a method of removing biofouling from surfaces. In embodiments, magnetic particles are applied to a surface comprising a biological material thereon. The biological material may be in the form on a layer/film/coating on the surface. Next, the magnetic particles are moved relative to the surface via a changing magnetic field. The motion of the magnetic particles relative to the biological material results in a force being exerted on the biological material sufficient to remove the material from the surface. An embodiment of the method is illustrated in FIG. 1. The top left panel shows a surface 100 to be cleaned having has a film 102 of a biological material thereon. The magnetic particles 104 have been applied to the top of the film 102. An electromagnet 106 is positioned near the surface 100 opposite the film 102. (A moving permanent magnet can also be used.) The magnetic field (black arrows) drives the motion of the magnetic particles 104 (white arrows). As shown in the top right panel, after the magnetic field has been applied, the magnetic particles 104 have moved laterally across the film 102, abrading it into smaller pieces and removing it from the surface 100. As illustrated in the bottom panels, the method can be applied to exterior surfaces such as a ship's hull or to interior surfaces such as the inside of a pipe.

The composition of the magnetic particles is not particularly limited. Any magnetic material may be used provided particles of the magnetic material are capable of being moved by a selected strength of a magnetic field. Illustrative magnetic materials include iron, and oxides and alloys thereof. The magnetic particles may be characterized by their size and shape. Although various sizes may be used, the size may be selected so that a film of the biological material is removed from the surface via a specific removal mechanism, e.g., via peeling-off. The "peel-off" removal mechanism is further described in the Example below and is distinguished from an "abrasion" removal mechanism. Whether peel-off versus abrasion has been achieved may be determined visually. By way of illustration, FIG. 2A (right) indicates peel-off whereas FIG. 2B (right) indicates abrasion.

Achieving removal via peel-off (versus abrasion) depends upon the type of biological material, the thickness of the film of the biological material on the surface, and the type of surface. Generally, for a selected strength (or selected maximum strength as defined below) of the magnetic field being used, to achieve peel-off, the size of the magnetic particles is selected such that the resulting force applied by the magnetic particles on the film is greater than the adhesive strength of the film to the surface but less than the cohesive strength within the film. The appropriate size may be determined using the methodology described in the Example, below. In embodiments, however, the particles are micron-sized (diameters from 1 μm to <1 mm) or nano-sized (diameters from 1 nm to <1 μm). Regarding shape, generally the particles are spherical, but other shapes may be used.

Figure 2A:
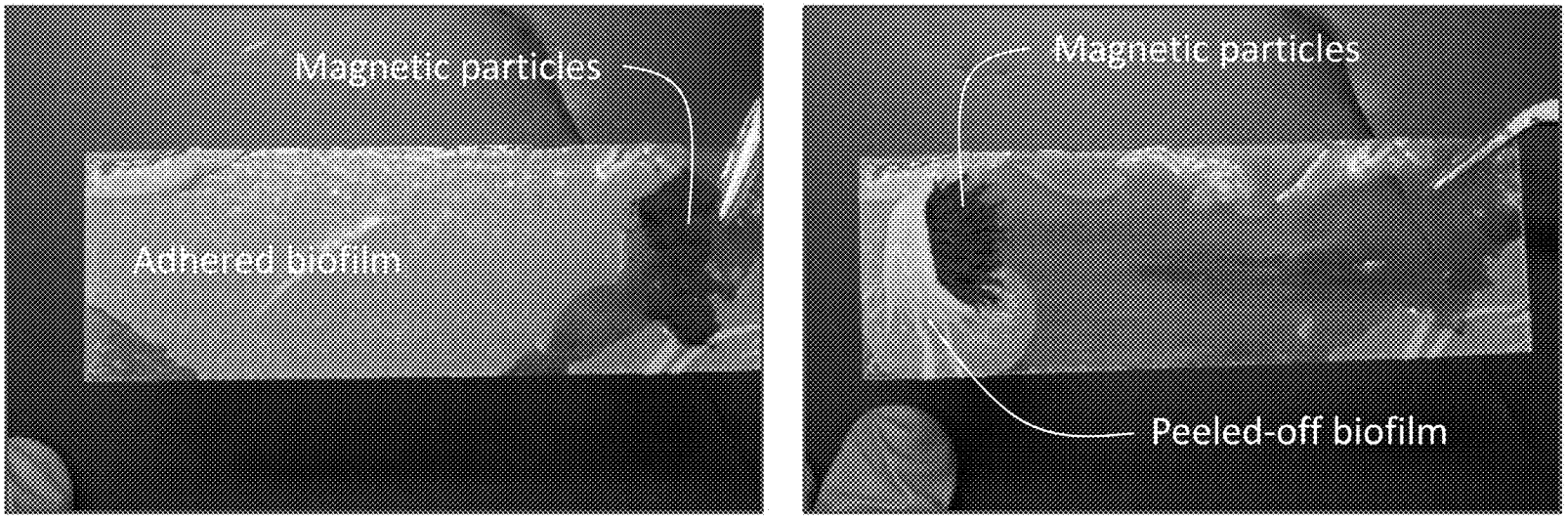
FIGS. 2A-2C show the results of the applying an embodiment of the present methods to a film of biological material.
Figure 2B:
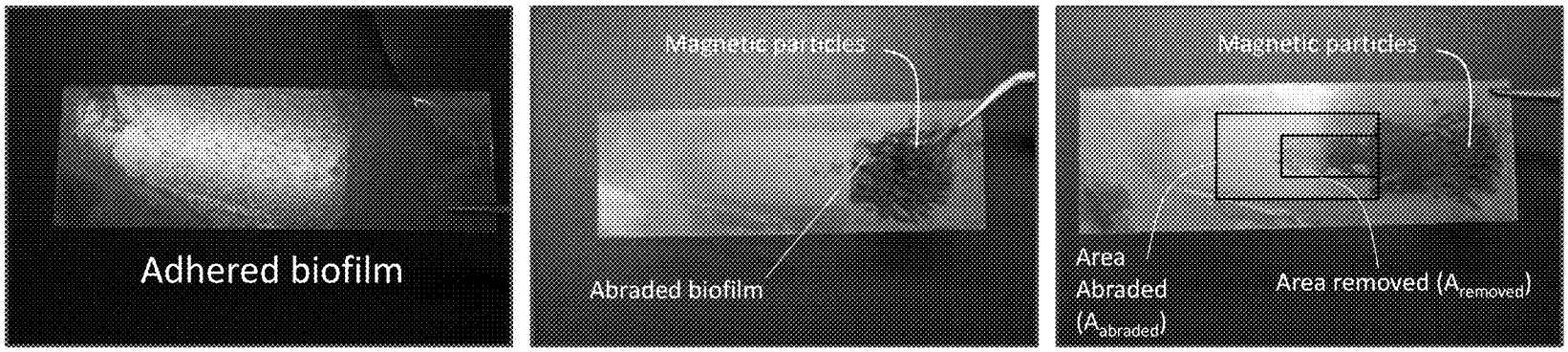

In the initial step of the method, the number of magnetic particles applied to the contaminated surface and/or resulting surface coverage of the magnetic particles may vary. These parameters may be selected to facilitate removal, including complete removal, of the biological material from the contaminated surface. However, as shown in FIGS. 2A, 2B, since the magnetic particles may be moved across the entire contaminated surface during the method, magnetic particles need not cover the entire contaminated surface in the initial application step.

In the method, the magnetic particles are exposed to a changing magnetic field. By "changing magnetic field," it is meant that the strength of the magnetic field differs in different locations across the contaminated surface as a function of time. This induces movement/translation of the magnetic particles relative to the biological material, which in turn, exerts a force on the biological material. The type of movement/translation is not particularly limited. The motion may be linear and in various directions, circular, etc. The changing magnetic field may be generated in various ways. As described in the Example, below, the changing magnetic field may be generated by moving a magnet relative to the contaminated surface (which encompasses moving the contaminated surface relative to the magnet). Alternatively, the changing magnetic field may be generated by passing a current through an electromagnet. (See FIG. 1.) In both cases, the magnet/electromagnet is close enough to the magnetic particles so that they are within the resulting magnetic field.

The conditions under which the changing magnetic field is applied can include its maximum magnetic strength. By "maximum magnetic strength" it is meant the largest magnetic strength experienced by the magnetic particles during the method, e.g., when a moveable magnet is placed directly underneath the magnetic particles. For a selected size of the magnetic particles, the maximum magnetic strength affects the resulting force exerted by the magnetic particles on the biological material. The maximum magnetic strength may be selected so that a film of the biological material is removed from the surface via a specific removal mechanism, e.g., via peel-off as described above.

Other conditions include the speed at which the magnetic particles are moved relative to the contaminated surface, the number of times the magnetic particles are moved across a reference point on the contaminated surface, and/or the overall time the magnetic particles are exposed to the changing magnetic field. These parameters may be selected to achieve removal via a specific removal mechanism and/or to achieve a desired amount of removal, e.g., complete removal.

The types of surfaces that may be subjected to the present methods are not particularly limited. They may be glass, plastic, metal, etc. The surfaces may be part of various structures such as a ship hull, food/beverage containers, components in membrane or water treatment plants, components of heat exchangers, etc. The biological material is also not particularly limited. The biological material may be polymicrobial in nature. The thicknesses of the films of biological material that may be removed are also not particularly limited. However, in embodiments, the film of biological material to be removed has a thickness in the range of from 1 μm to 1 mm, 10 μm to 500 μm, 25 μm to 250 μm, or 50 μm to 200 μm.

At least some embodiments of the present disclosure exhibit one or more of the following advantages: effective against all types of biofouling organisms; effective at all stages in the biofouling process including late stages, which has not been achieved by other state of the art technologies; scalable for different applications ($10^{-6}$ meter to $10^{2}$ meter scale); requires no modification of existing surfaces; non-destructive to target surfaces; energy efficient; environmentally safe; can be simply and precisely controlled by altering the magnetic field; limits operational interruptions for biofouling removal (requires no invasive periodic maintenance); requires minimal human physical labor.

Example

Methods and Experiments

Culturing Bacteria and Growing Biofilms. The organism Pseudomonas aeruginosa (strain PAO1-gfp) was used for static biofouling assays. Freezer stock of *P. aeruginosa* was spread onto Langmuir Blodgett (LB) agar plates using a sterile loop. Plates were incubated at 37° C. overnight to facilitate bacterial growth, then were stored in a refrigerator at 4° C. In order to grow the bacteria in liquid culture, *P. aeruginosa* were initially transferred from plates into two culture tubes each containing 10 mL of tryptic soy broth (TSB) media and incubated for 24 hours in an orbital shaker at 37° C. The two tubes of liquid culture bacteria were then transferred into a sterile glass container containing 500 mL of 1× TSB. Sterile glass slides (25.4 mm×76.2 mm and 1.2 mm thick, Thermo Scientific) and plastic tubes (13 mm in inner diameter and 16 mm in outer diameter, U.S. Plastic Corp.) were submerged into the TSB/*P. aeruginosa* mixture, then incubated at room temperature for 3 days to allow bacteria to adhere to the surfaces of slides and tubes to form biofilms thereon. Abrasion tests were performed with biofilms dried for either 20 min or 60 min to demonstrate the effect of liquid concentration on abrasion. Biofilms dried for 20 min contained more liquid than those dried for 60 min.

Preparation of PDMS Films. PDMS (Polydimethylsiloxane) films were chosen to model the biofilm as the stiffness and thickness of the PDMS film can be systematically controlled. A glass slide was placed on a spin coater (Laurell Technologies Corp., Model WS-650MZ) and PDMS solution (Sylgard 184, Dow Corning), with a volume ratio of the curing agent to the silicone elastomer base of 1:10, was deposited onto the glass slide. The glass slide was spun for 1 min and the thickness of the PDMS film was controlled by varying the spin speed. Speeds of 500 rpm, 1000 rpm, 1500 rpm, and 2000 rpm resulted thicknesses of about 100 μm, 60 μm, 20 μm, and 10 μm, respectively. Additionally, different volumes (0.25, 0.5, and 1 mL) of PDMS solution were added onto the glass slides. The droplets of PDMS solution spread out to form films having thicknesses of 170 μm, 240 μm, and 350 μm, respectively. Thicknesses were estimated by measuring the weight difference of the glass slide before and after the coating with PDMS. Next, glass slides were heated at 70° C. for 24 hours in an oven. Finally, individual solidified PDMS films on the glass slides were shaped to form a rectangle (60 mm×15 mm) to remove the PDMS film along the edge so that the effective PDMS film for the abrasion test is located at the center of the glass slide.

Abrasion by Magnetic Particles. A magnetic cylinder (7 μm diameter, 19 μm height, Nickel-Plated Neodymium, maximum pulling force to separate the magnet and an iron plate: 140 N) was purchased from McMaster can. Iron filings (median diameter ~10 μm, Shinco) were used as the magnetic particles. First, 0.2 g of iron filings were deposited on the right-hand side of the film and the magnetic cylinder was placed on the opposing side of the glass slide, oriented perpendicular to the glass slide. Then, the abrasion was conducted at the speed around 3 cycles (a cycle corresponds to one complete movement starting from the right to left back to right) per second for 20 min.

Results and Discussion

Biofilm Abrasion Tests. As noted above, abrasion tests were conducted on plastic pipes having inner surfaces contaminated with a biofilm which had been dried for 60 min. The results showed removal of the biofilm from the inner surfaces (images not shown).

Figure 2C:
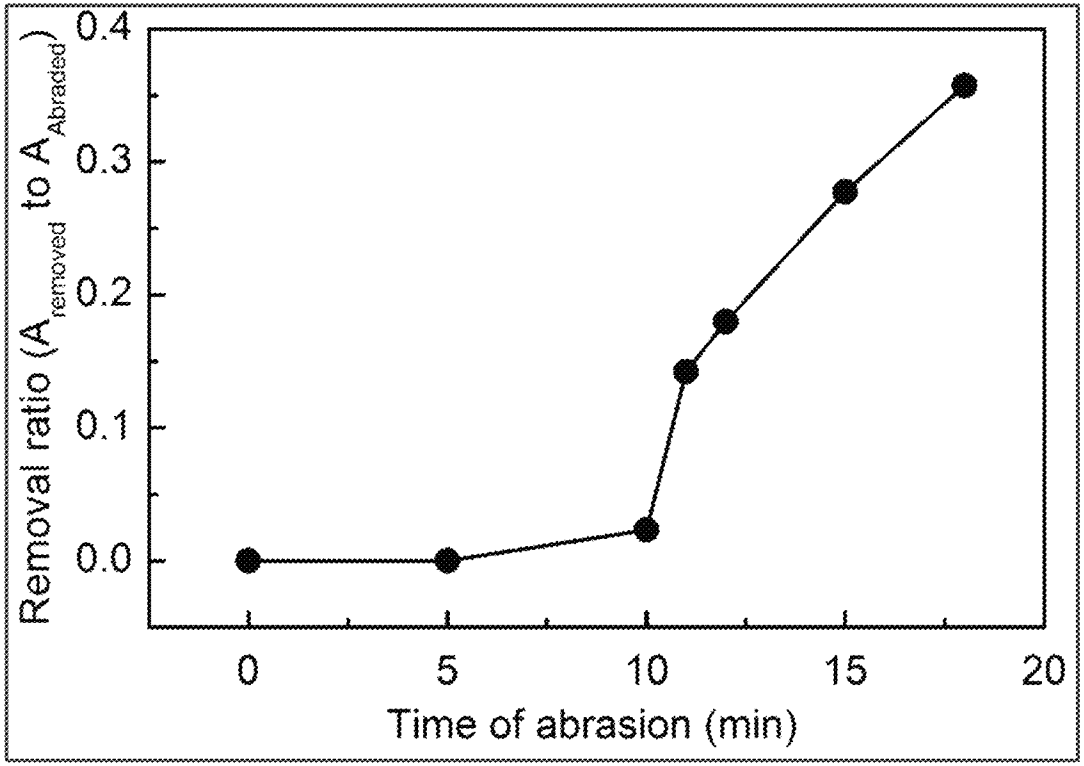

In order to quantitatively investigate biofilm removal, static biofouling assays on flat glass slides were conducted as described above. The results are shown in FIGS. 2A-2C. FIG. 2A shows images of a biofilm contaminated slide which has been dried for 20 min, before the abrasion test (left) and after one movement of the magnet starting from the right to the left (thus, less than 1 cycle). FIG. 2B shows images of a biofilm contaminated slide which has been dried for 60 min, before the abrasion test (left), after 10 min of abrasion (middle), and after 15 min of abrasion (right). FIG. 2C plots the removal ratio versus abrasion time for the biofilm contaminated slide of FIG. 2B. Removal ratio corresponds to the ratio of the area of removed biofilm (corresponding to the total area of exposed glass slide) to the abraded area (corresponding to the total area contacted by the iron filings). See FIG. 2B, right for measurements of the area of removed biofilm and the abraded area.

The results show that for the biofilm that had been dried for 20 min (which contains more liquid), less than a cycle of abrasion was able to completely remove the biofilm (FIG. 2A, right). Notably, the biofilm actually peels off from the glass slide, facilitating its complete removal from the slide. By contrast, the biofilm that had been dried for 60 min was only partially removed after 15 min of abrasion (FIG. 2B, right). In addition, instead of peeling off in large, intact pieces, this biofilm is scraped, torn, and/or worn away in much smaller pieces. Removal via scraping/tearing/wearing away is referred to as "abrasion" herein (by contrast to removal via "peeling-off"). As shown in FIG. 2C, the removal ratio is proportional to the time of abrasion. Without wishing to be bound to any particular theory, it is thought that the different results are related to the thickness and stiffness of the biofilms as well as the cohesive strength within the biofilm and the adhesive force between the biofilm and the glass slide. Loss of water (in the biofilms that had been dried for 60 min) may lead to decreased cohesive strength as well as decreased adhesive strength due to decreased interactions between extracellular polymeric substances (EPS) moieties.

In order to further quantitatively investigate biofilm removal, PDMS film abrasion tests were conducted as described above.

Figure 3:
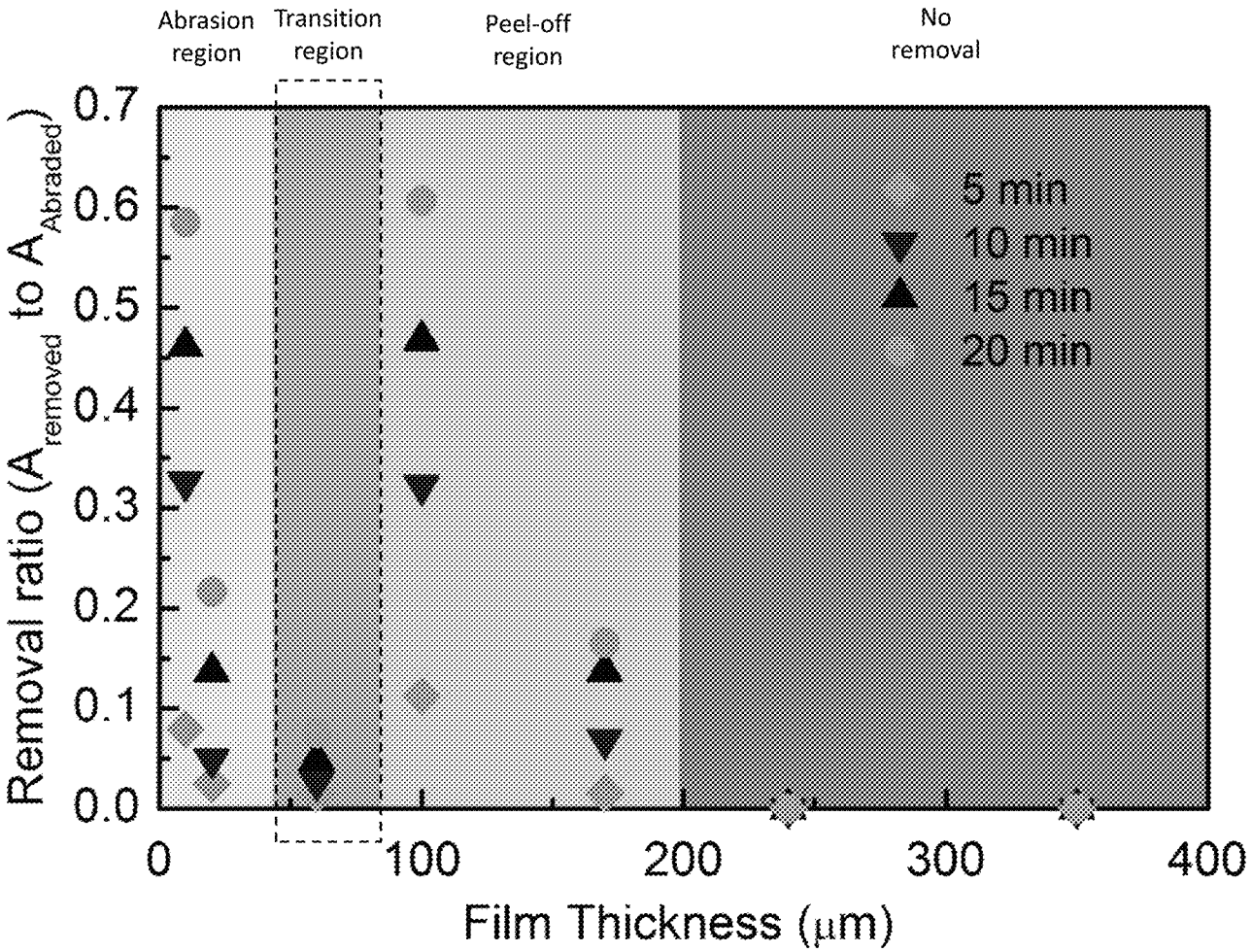
FIG. 3 plots the removal ratio of a PDMS film having different thicknesses and after being subjected to a changing magnetic field for different periods of time.

PDMS Film Abrasion Tests. FIG. 3 plots the removal ratio of PDMS films having different thicknesses (10, 20, 60, 100, 170, 240, and 350 μm) and different abrasion times (5, 10, 15, and 20 min). Thick PDMS films (240 and 350 μm) could not be removed under the conditions used in the tests. This may be because the films were too thick as compared to the size of iron filings (~10 μm) and/or the magnetic field strength too low. Thus, the friction force exerted on the PDMS film was not sufficient to deform the film to achieve peel-off or create sufficiently deep scratches to achieve abrasion. Larger iron filings and/or increase magnetic field strength may be used to remove such films. As the film thickness decreases (100 and 170 μm), significantly more film is removed. In addition, at these film thicknesses, the removal mechanism was peeling-off (versus abrasion). Thus, these results are similar to those observed for the biofilm that had been dried for 20 min. At a film thickness of ~60 μm, only small amounts of film were removed. However, as the film thickness further decreases (10 and 20 μm), greater amounts of film were removed. In addition, at these film thicknesses (10 and 20 μm), the removal mechanism was abrasion (versus peeling-off). Thus, these results are similar to those observed for the biofilm that had been dried for 60 min.

Excluding PDMS films thicker than 240 μm, it appears that there is a minimum removal ratio at a film thickness of ~60 μm, which is ~5 times larger than the iron filings. This film thickness represents a transition point that distinguishes the different removal mechanisms. The removal mechanism is peeling-off for films greater than about 60 μm and the removal mechanism is abrasion for film thicknesses smaller than about 60 μm. For a given size of the magnetic particles and magnetic strength, the transition thickness is that thickness value (e.g., 60 μm) above which (e.g., above 60 μm) the film can be removed via peeling-off and below which value (e.g., below 60 μm) the film is removed via abrasion.

Without wishing to be bound to any particular theory, it is thought that this transition thickness and different removal mechanisms are related to the interplay between the cohesive strength (film stiffness), the adhesion force between the film and the glass slide, and the forces exerted by the magnetic particles on the film. Above the transition thickness, the force from the magnetic particles on the film is greater than the PDMS-glass adhesion strength but not as great as the film's cohesive strength. In this region, the film is able to be peeled-off. Below the transition thickness, the force from the magnetic particles on the film is less than the PDMS-glass adhesion strength but greater than the film's cohesive strength. In this region, the film is abraded off. At the transition thickness, the force from the magnetic particles on the film is less than (or comparable to) both the film's adhesion strength and the film's cohesive strength. In this region, none or only a minimal amount of film can be removed.

The word "illustrative" is used herein to mean serving as an example, instance, or illustration. Any aspect or design described herein as "illustrative" is not necessarily to be construed as preferred or advantageous over other aspects or designs. Further, for the purposes of this disclosure and unless otherwise specified, "a" or "an" means "one or more."

The foregoing description of illustrative embodiments of the disclosure has been presented for purposes of illustration and of description. It is not intended to be exhaustive or to limit the invention to the precise form disclosed, and modifications and variations are possible in light of the above teachings or may be acquired from practice of the disclosure. The embodiments were chosen and described in order to explain the principles of the disclosure and as practical applications of the disclosure to enable one skilled in the art to utilize the disclosure in various embodiments and with various modifications as suited to the particular use contemplated. It is intended that the scope of the disclosure be defined by the claims appended hereto and their equivalents.

What is claimed is:

1. A method of removing a film of a biological material from a surface, the method comprising:

applying magnetic particles having a size to the surface contaminated with the film of the biological material, the film having a cohesive strength within the film and an adhesive strength between the film and the surface, and wherein the film has a thickness in the range of about 100 μm to up to 200 μm; and exposing the magnetic particles to a changing magnetic field having a maximum magnetic strength to move the magnetic particles relative to the contaminated surface, thereby removing the film from the surface, wherein the size of the magnetic particles and the maximum magnetic strength of the changing magnetic field are selected to provide a force on the film that is greater than the adhesive strength but less than the cohesive strength so that the film is removed via peel-off.

2. The method of claim 1, wherein the film is removed after a single passage of the magnetic particles across the film.

3. The method of claim 1, wherein the changing magnetic field is generated by moving a magnet relative to the contaminated surface.

4. The method of claim 1, wherein the changing magnetic field is generated by passing a current through an electromagnet.

5. The method of claim 1, wherein the magnetic particles are micron-sized particles.

6. The method of claim 5, wherein the magnetic particles comprise iron.

* * * * *